United States Patent [19]

Enix

[11] Patent Number: 4,478,289

[45] Date of Patent: Oct. 23, 1984

[54] SIDE MOUNTED SOIL RIPPING MECHANISM

[75] Inventor: Clayton L. Enix, Pearcy, Ark.

[73] Assignee: Weyerhaeuser Company, Tacoma, Wash.

[21] Appl. No.: 452,528

[22] Filed: Dec. 23, 1982

Related U.S. Application Data

[63] Continuation-in-part of Ser. No. 246,550, Mar. 23, 1981, abandoned.

[51] Int. Cl.[3] ..... A01B 13/08; A01B 63/102

[52] U.S. Cl. ..... 172/136; 172/811; 172/297; 172/464

[58] Field of Search ..... 172/827, 810, 136, 304, 172/307, 297, 464

[56] References Cited

U.S. PATENT DOCUMENTS

| | | | |
|---|---|---|---|
| 1,807,150 | 5/1931 | Caldwell . | |
| 1,859,496 | 5/1932 | Buffington . | |
| 2,295,264 | 9/1942 | Le Bleu . | |
| 2,358,298 | 9/1944 | Benjamin . | |
| 2,396,739 | 3/1946 | McCauley . | |
| 2,593,679 | 4/1952 | Kaupke . | |
| 2,695,468 | 11/1954 | MacLeod et al. . | |
| 2,732,196 | 1/1956 | Wood . | |
| 2,737,868 | 3/1956 | Morkoski . | |
| 2,743,655 | 5/1956 | Rafferty . | |
| 3,046,917 | 7/1962 | Kasper . | |
| 3,092,187 | 6/1963 | Hunter et al. . | |
| 3,295,612 | 1/1967 | Mayo et al. . | |
| 3,387,665 | 6/1968 | Fishcher et al. . | |
| 3,433,310 | 3/1969 | Harper . | |
| 3,503,456 | 3/1970 | Larson . | |
| 3,527,308 | 9/1970 | Bernotas et al. . | |
| 3,893,516 | 7/1975 | Zimmerman . | |
| 4,135,584 | 1/1979 | Smith | 172/827 |
| 4,152,991 | 5/1979 | Stedman et al. . | |
| 4,204,578 | 5/1980 | Stedman . | |

FOREIGN PATENT DOCUMENTS 203608 10/1956 Australia .

*Primary Examiner*—Richard J. Johnson

[57] ABSTRACT

An improved subsoil ripping device is disclosed in which ripper teeth are mounted on the sides of a tracked, crawler-type prime mover approximately opposite the center of mass. The frames carrying the ripper mechanisms are most conveniently mounted on the arms of a conventional bulldozer blade. In order to increase resistance to lateral forces acting on the ripper teeth, the frames may be bridged by a rigid arch. Alternatively, they may be braced by a strut acting between the ripper assembly and the tractor frame. If this latter arrangement is used, the ripper assemblies are preferably hinged to the blade arms to permit full normal blade movement. A ripper made according to the present teaching is especially useful when operating on uneven or debris covered ground. It does not tend to rake up debris, and thus does not require time and fuel for clearing the teeth. Because of the location of the teeth, the prime mover is easier to steer and a rip of more uniform depth can be maintained.

5 Claims, 11 Drawing Figures

Fig. 7
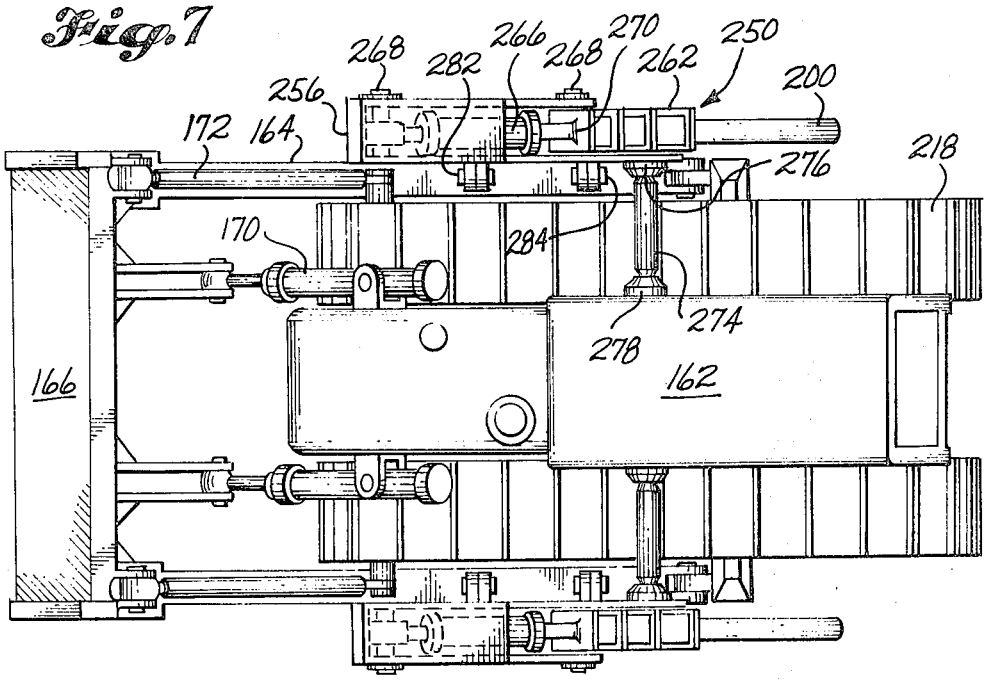
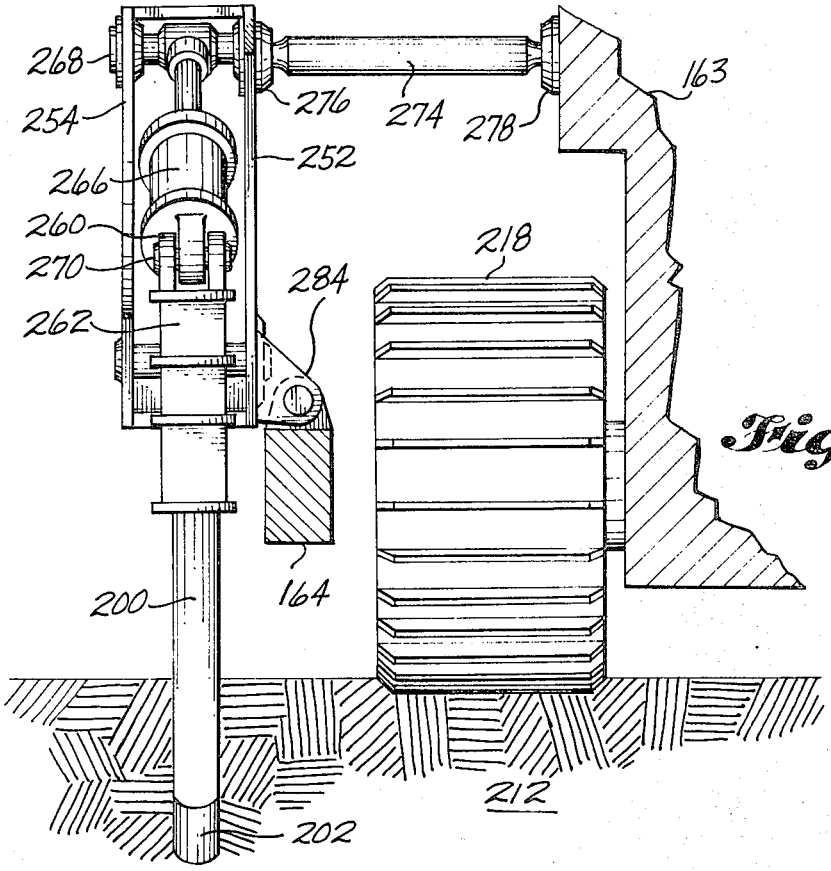
Fig. 8

SIDE MOUNTED SOIL RIPPING MECHANISM

CROSS REFERENCE TO RELATED APPLICATION

The present application is a continuation-in-part of application Ser. No. 246,550, filed Mar. 23, 1981 now abandoned.

FIELD OF THE INVENTION

This invention is concerned with an improvement in apparatus for ripping or fracturing subsoils. It is particularly advantageous in sites where the ground surface is covered with debris which ordinarily interferes with ripping operations or where there are subterranean rocks or other obstructions.

BACKGROUND OF THE INVENTION

Soil rippers and related devices have found application in a number of areas. They are commonly used on construction sites for fracturing subsoils, particularly when these are underlaid by hardpans or are rocky. Rippers also find wide agricultural use where they are likewise employed for breaking up hardpan or other types of impermeable subsoils. Cable plows are a modified type of ripper which simultaneously create a deep, narrow trench and bury an electrical or other type of cable within the trench.

Agricultural ripping usually has a two-fold purpose in that it fractures subsoils to make them permeable to both plant roots and water. When these impermeable formations are close to the surface; the soil may be poorly drained yet have a tendency to dry out rapidly under droughty conditions. Fracturing of these impermeable soils by ripping creates an environment which can be more easily penetrated by roots. The rip lines themselves tend to act as moisture reservoirs.

One large-scale application of ripping is in reforestation of logged or otherwise unproductive forest lands. There is much land in the southeast and the southern part of mid-continent America in which forest soils are underlaid by shales or hardpans which lie close to the surface. Tree growth on such lands is less than optimum from the standpoints of both size and rate, even though other aspects of the environment are favorable. It has become a standard silvicultural practice in many areas to rip the sites before they are replanted with tree seedlings. Commonly, the seedlings will be planted directly in rip lines, which are located on a spacing considered optimum from the silvicultural standpoint. Depending on the nature of the soil and subsoil, the rips may be anywhere from 40 cm to 1 m in depth, or even greater.

Because of the strength of the substrate and the considerable depths to which it is being fractured, ripping is normally carried out using large tracked, crawler-type prime movers. The land itself is often rough and uneven and is typically covered with logging debris and stumps. All of these considerations work together to virtually exclude the use of smaller, lower powered prime movers.

A typical ripper comprises a frame carrying a tool bar, one or more ripping teeth mounted on the tool bar, and an actuating mechanism. This is rigidly bolted behind a crawler-type tractor. Most typically, because of the high amount of power required, not more than two ripper teeth will be used. The mechanisms used to control the position and attitude of the teeth are well known. These usully have either a radial-arm type control linkage or a parallel-arm type, with the latter type prevailing. Hybrid types are also reasonably common. These may be made with either compound radial linkages between the control mechanism and the ripper teeth, or a combination parallel-radial linkage. Examples of these types can be seen in the following patents.

Larson, U.S. Pat No. 3,503,546 shows a hybrid linkage in which a lower cylinder serves to actuate a parallel-arm motion and an upper cylinder can be used to give a radial arm action. The two cylinders, which may be operated simultaneously, produce a form of motion on the ripper tooth which will be intermediate between the two types.

Mayo, et al, U.S. Pat. No. 3,295,612 shows a modified parallel-arm linkage, which, in effect, gives an arcuate entry of the tool into the ground, similar to a radial type.

The major difference between the parallel arm and the radial arm control linkages is in the mode of entry of the ripper tooth into the ground. The parallel arm control linkage causes essentially a straight line insertion of the tool into the ground in the same attitude it will have during operation. In radial-arm linkage, the tool tip describes a wide arc as it enters the ground. This type generally requires more power on entry because the ripper tooth typically has a less favorable angle and must sweep through the ground to assume an operating attitude. This deficiency is one of the reasons for the present higher popularity of parallel-arm type rippers.

One problem encountered in using rippers on debris-covered land is that they tend to act as rakes. Accumulated debris periodically will be discharged by withdrawing the teeth from the ground. Frequently the tractor operator must resort to maneuvers such as reversing his machine to clear this accumulated debris. In this regard, a radial arm action has an advantage over the parallel arm action in that it will clear debris more rapidly. This is a problem of no small consequence in ripping logged over forest land. It is common for the ripper operator to spend about 25% of his time in the field clearing accumulated debris. This wasted time is expensive because of the high capital cost of the prime mover and also because of the large amount of fuel and operator time that is used unproductively. Conventional rippers present other problems as well. Because they are located behind the prime mover, they tend to act as a rudder, which interferes with steering. When the tractor operator must make a sharp turn while ripping, he must overcome not only the forward resistance to the ripper teeth, but the newly introduced lateral component as well. Furthermore, as the prime mover rides over objects such as a stump or a log, there is a significant pitching action that is magnified by the distance between the tractor center of mass and the ripper teeth. At one point, this drives the ripper teeth much deeper than required into the ground, thus requiring substantially more power. At another point in travel the ripper teeth may be lifted completely from the ground, thus failing to do the job for which they are intended. The net result is an undesirable undulating rip depth.

The present invention has been successful in overcoming these problems by side mounting the rippers on a crawler-type prime mover approximately opposite the fore/aft center of mass.

While side mounted rippers have been proposed previously, they have never been made available commercially. Perhaps one reason is that they have not successfully addressed a major problem of resisting lateral thrust forces that act on the ripper teeth during operation. One instance in which these forces are very high is when a tooth tries to deflect around the edge of a large subterranean boulder. Ripper mechanisms that are not substantially mounted can literally be twisted off the vehicle.

One side-mounted ripping device known to Applicant is shown in Stedman et al., U.S. Pat. No. 4,152,991. This is a ballast ripper designed for breaking up compacted railroad bedding. It consists of two vertical shafts and appropriate bearings, with horizontal ripper elements working arcuately beneath the railroad ties. Both the prime mover and the ripper mechanism are significantly different from those in the present invention. It is hard to visualize the Stedman machine being useful for anything beyond the specific application for which it was designed.

U.S. Pat. No. 4,204,578, also to Stedman, shows a side-located ripper mechanism having a hybrid-type action. The ripper teeth and actuating means are mounted on "wing portions" comprising buttressed vertical faces welded on the outside of a U-shaped frame. This frame is located in the position normally occupied by a blade arm and blades.

McCauley, in U.S. Pat. No. 2,396,739, shows a bulldozer equipped with ripper teeth that function when the tractor moves backwards. Two of the teeth are mounted on the outside of the blade arms, immediately behind the blade.

U.S. Pat. Nos. 2,358,298, 2,737,868, 3,046,917, 3,092,187, and 3,387,665 all show side-mounted cultivators on light agricultural tractors. The patent to Rafferty, U.S. Pat. No. 2,743,655, shows mid-mounted plows which are essentially in line with the rear wheels of the vehicle.

Most of these devices are either light duty implements designed for tilling or cultivating surficial soil, or would not be suitable for subsoil ripping in many soils because of the side thrust problem.

SUMMARY OF THE INVENTION

This invention comprises an improved soil ripper. It is a device particularly well adapted for use on rough ground or on debris-covered sites. The improvement resides principally in the positioning of the ripper teeth and in the provision for resisting side or lateral thrust forces on the teeth. Typically, the ripper mechanisms would be within rigid frames which are mounted on a U-shaped frame which usually comprises the blade and blade arms of a blade-equipped crawler-type prime mover. The frames would contain means for holding a ripper tooth and control means to determine the position and attitude of the tooth. When in the ripping position, the teeth will be positioned outside the tracks and between the fore and aft axles of the prime mover, preferably approximately opposite the center of mass of the machine. The control means can be either a radial arm linkage, a parallel arm linkage, a compound radial arm linkage, a hybrid linkage, or some new combination of these. This side-mounted arrangement is advantageous from a number of standpoints. One principal advantage is that the improved construction does not tend to rake piles of debris, which must then be discharged from the mechanism. Instead, the crawler-tracks run over the debris, which is securely held down by the weight of the vehicle. Unless the debris is very large, it will simply be snapped off by the ripper teeth. On a prime mover of the size normally used in preparing forest land for replanting, the ripper teeth can readily break off small logs as large as 30 cm in diameter, or even greater. Roots and small stumps are dealt with in similar fashion. A further advantage is found in the much better maneuverability of the tractor. Because the ripper teeth are mounted on the side, they do not have the rudder action of a rear-mounted ripper. The equipment operator has thus gained for more rapid maneuverability when this is necessary. Finally, the ripper teeth do not have the tendency to move up and down in the ground as badly when the prime mover rides over an obstruction, because the lever arm between the obstruction and the ripper tooth has been significantly shortened. All of these advantages combine to permit a high ratio of useful operating time to debris cleaning time with attendant increase in field efficiency and a major saving in fuel consumption.

A major improvement in the present ripper is the provision for resisting torsional forces on the arm portions of the mounting frame. These forces can occur when a ripper tooth hits a subterranean or other object in a manner that tends to deflect it toward or away from the prime mover. On a side-mounted ripper, such forces can achieve magnitudes so great that the arm of the mounting frame can be severely rotated and permanently deformed, or even broken. In the present invention, torque rotation or resisting means associated with the ripper subframes are provided to resist rotation or twisting caused by these laterally acting forces. In one embodiment, the torque resisting means comprises a rigid arch which bridges the ripper subframes on opposite sides of the tractor. In another embodiment, the torque resisting means is a strut or struts acting between the ripper subframes and the tractor frame.

It is an object of the present invention to provide a soil ripper with many improved operating characteristics.

It is a further object to provide a soil ripper that has greater efficiency in debris-covered sites.

It is yet an object to provide a soil ripper that does not accumulate debris ahead of the ripper teeth.

It is another object to provide a soil ripper which has improved steering characteristics.

It is still another object to provide a soil ripper that has less tendency to cause uneven rips as the prime mover passes over obstacles.

It still is a further object to provide a side-mounted ripper that effectively resists lateral thrust forces acting on the ripper teeth.

These and other objects will become readily apparent on reading the following detailed description, accompanied by reference to the drawings.

BRIEF DESCRIPTION OF THE DRAWINGS

FIG. 7 is a top plan view of the ripper shown in FIGS. 5 and 6.

FIG. 8 is a fragmentary rear elevation view, partially in cross section, showing details of one way of mounting a ripper subassembly to a blade arm.

DESCRIPTION OF THE PREFERRED EMBODIMENTS

Figure 1:
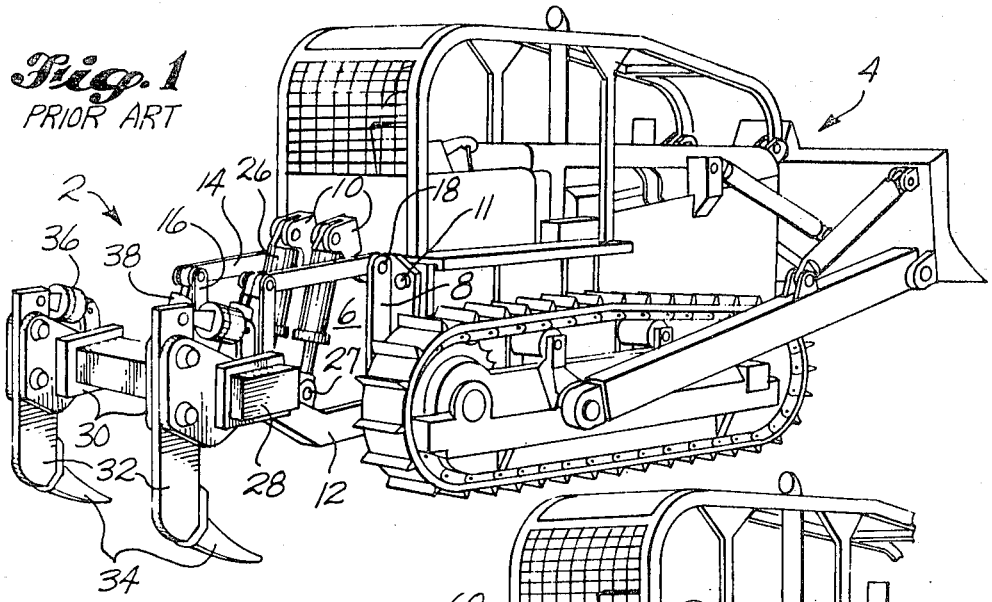
Fig. 1 PRIOR ART
FIG. 1 is a perspective view of a prior art ripper using a parallel arm-type control linkage.

FIG. 1 illustrates a conventional soil ripper using a parallel arm control linkage. Ripper assembly 2 is attached to a crawler-type tractor 4. The ripper consists of a base frame 6 carrying vertical frame members 8 and upstanding ears 10. The frame is attached to the prime mover by a series of heavy bolts 11. A lower parallel arm member 12 is pivotally attached to frame member 8 at 20, near the point of attachment of the ripper frame to the prime mover. An upper parallel arm member 14 is similarly pivotally attached to frame member 8 at 18. The vertical links 16 complete the parallelogram. These are pivotally attached to the upper parallel arms at 22 and to the lower arms at 24. A pair of main control hydraulic cylinders 26 are pivotally attached to frame ears 10 at their upper ends. The cylinder piston rods are likewise pivotally attached to lower frame members 12 at 27. The position of the piston rods in cylinders 26, acting through the parallel arm mechanism, controls the elevation of tool bar 28, which is rigidly attached to vertical members 16. The tool bar 28 contains mounting brackets 30, which hold heavy ripper teeth 32. These are typically equipped with wear-resistant forwardly raked tips 34.

This type of ripper also usually includes a pair of shock absorbers 36 and tooth attitude trimming cylinders 38.

Figure 4:
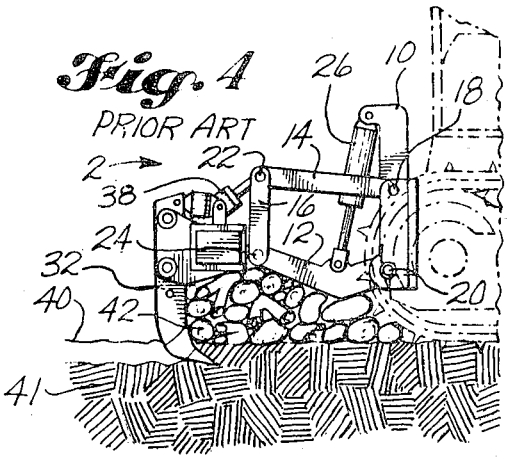
Fig. 4 PRIOR ART
FIG. 4 is a fragmentary side view, partially in section, of a prior art ripper having a parallel arm control linkage, further showing the tendency to accumulate debris.
Figure 5:
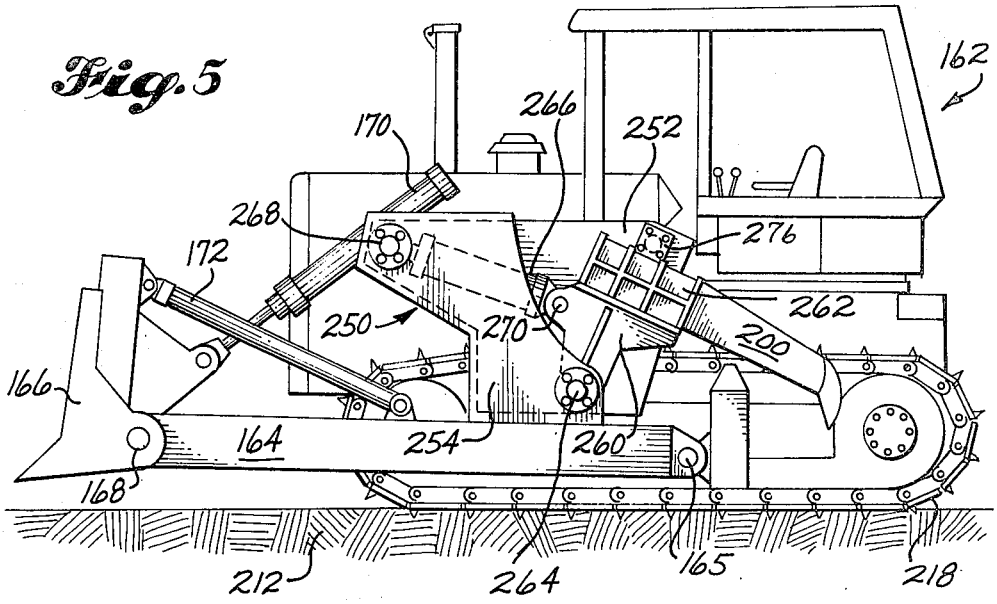
FIGS. 5 and 6 are a side elevation views of one version of a ripper made by the teachings of the present invention.
Figure 6:
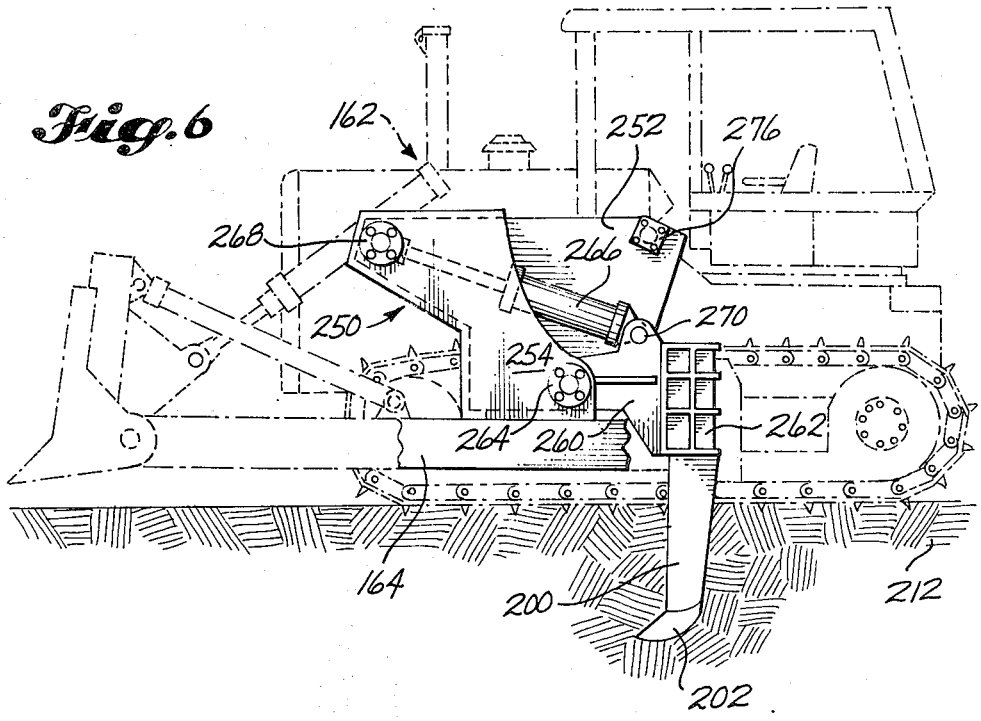

Referring to FIG. 4, we see an example of a parallel arm ripper that has been operating an debris-covered ground. A mass of material 42 has accumulated ahead of the teeth 32 by their raking action during the formation of rip 40 in soil 41. Note that in a parallel arm ripper it is difficult to disengage debris of this type, because if the ripper teeth are raised there is a tendency to pinch the debris between the teeth and the frame rather than to clear it. In this situation, it is often necessary for the tractor operator to back up over the accumulated debris pile before it can be released. This causes a discontinuity in the rip line. However, of more significance, it is extremely wasteful of time and fuel. On many sites, clearing debris from the ripper teeth will account for about 25% of field operation hours.

Figure 2:
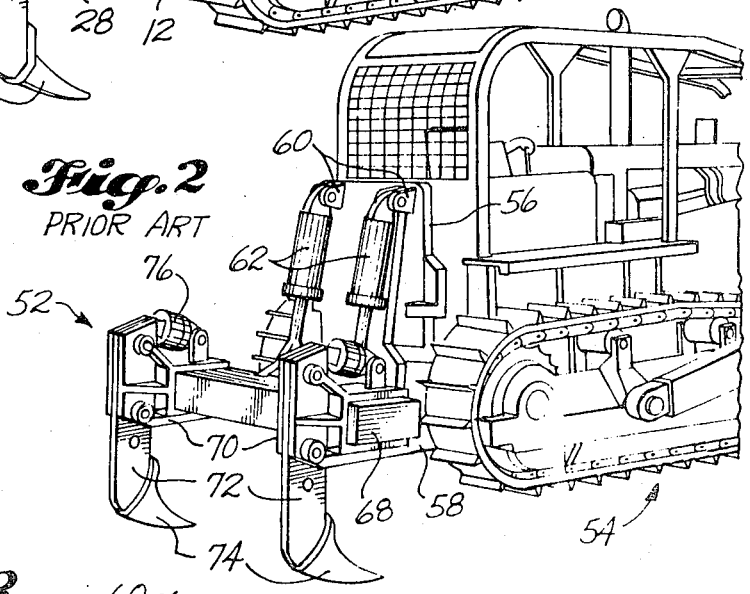
Fig. 2 PRIOR ART
FIG. 2 is a partial perspective of a prior art ripper using a radial arm-type control linkage.
Figure 3:
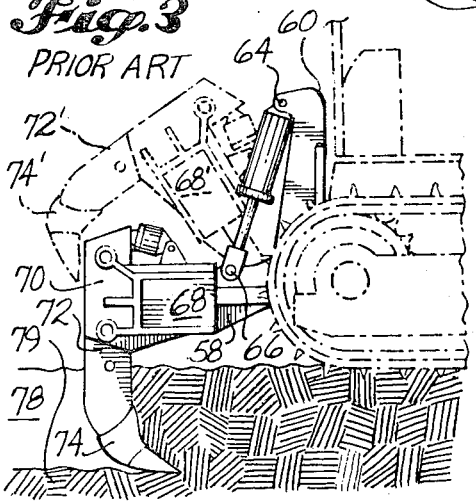
Fig. 3 PRIOR ART
FIG. 3 is a fragmentary side view, partially in section, of a prior art radial arm-type ripper.

FIGS. 2 and 3 show a typical prior art radial arm ripper. The ripper 52 is rigidly connected to a crawler-type tractor 54. The ripper is mounted on frame 56 and carries heavy longitudinal arms 58 pivotally attached to the frame, at a point not shown, behind the track of the prime mover. Frame 56 bears ears 60 mounted on a reinforcing member near its upper edge. These ears carry hydraulic cylinders 62 which are pivotally attached at 64. The piston rods of these cylinders are attached to longitudinal arms 58 at 66. The heavy longitudinal arms carry a tool bar 68. In turn, this holds two mounting brackets 70 which contain ripper teeth 72. These ripper teeth likewise have hardened tips 74. At the upper end of the teeth shock absorbers 76 tend to reduce heavy impact loads.

FIG. 3 shows teeth 72 forming rip 78 in soil 79. The alternate position version of FIG. 3 shows the action of the radial arm linkage as it is removed from the ground. This type of linkage will clear debris more efficiently than the parallel arm linkage. However, it has the disadvantage that on re-entry its attitude tends to be at an acute angle to the ground's surface, rather than essentially vertical. For this reason, re-entry to operating depth requires more power and is slower than is the case with a parallel arm ripper. Because of the essentially vertical attitude of the axis of the tooth at the time of entry, the tips of a parallel arm type tend to plow themselves quickly into operating depth with a minimum of additional force being required.

FIGS. 5 through 8 show one preferred version of the present invention. A crawler-type tractor 162 is equipped with side-mounted ripper assemblies 250. These are mounted on conventional blade arms 164, carrying a blade 166. The blade arms are attached to the tractor frame by a pivot or ball joint 165. Blade 166 is pivotally mounted to arms 164 at point 168. The attitude or vertical angle of the blade is controlled by a pair of main hydraulic cylinders 170. Hydraulic cylinders 172 serve as stabilizing struts and also act to give some control over horizontal angle of the blade. The blade and arms described in FIGS. 5 through 8 illustrate a common tilt-type blade arrangement. It is to be understood that the ripper assemblies may be mounted on any rigid, substantially U-shaped frame. In the illustrations, the crawler tracks 218, are seen running on a ground surface 212.

The ripper assemblies 250 comprise a frame, an operating or control arm bearing a ripper tooth, and a hydraulic cylinder for controlling tooth attitude. In the illustration shown, the frame comprises an inner or medial steel plate 252, on outer or lateral plate 254, and a steel web member 256 (FIG. 7), which unites the two plates into a rigid box structure, open to the rear. The ripper control arm 260 is a modified third-class lever. At one end it bears a chuck or tooth-holder 262, containing a ripper tooth 200. This tooth may optionally be equipped with a tip 202 to resist wear. Control arm 260 is pivotally mounted in the box frame at pivot point 264. Attitude of the tooth is controlled by a hydraulic cylinder 266, which operates between the box frame at pivot point 268 and the control arm at pivot point 270. Control cylinders 266 control both the entry and withdrawal of the ripper teeth from the ground, as well as the operating attitude.

An important element of the present embodiment of the invention is strut 274, best seen in FIG. 8. This strut is preferably a double ball-ended rod which is engaged in ball seat 276, attached to the inner wall 252 of the ripper frame assembly, and ball seat 278, attached to the tractor frame 163. This strut effectively stabilizes the ripper assemblies against lateral thrust forces, which may occur during operation of the unit. Another important feature of the present version is the manner in which it is mounted to the blade arms. In the most preferred version, this mounting comprises a pair of heavy hinges or clevis linkages 282,284. The combination of the hinged mounting to the blade arms with the double ball-ended strut allows full vertical freedom of movement of the blade arms 264 from a position in which blade 166 is engaged with the ground surface to a second position in which it is fully clear of the surface. The arrangement also is tolerant of side-to-side adjustment of the blade, as might be accomplished by secondary cylinders 172. This combination of hinged mounting with a lateral thrust transfer element gives great strength to the assembly, as well as great versatility during use.

It is typical of all versions of the present invention that the control cylinders will have an overload sensor. This serves as a safety device in case the tooth should hit a very large rock or other obstacle which could cause an overload. When such an occasion occurs, the overload sensor would typically activate cylinder 266 automatically to swing ripper tooth 200 out of the ground. In such a situation, the operator would normally manually control the reinsertion of the ripper tooth into the ground, although this could be done automatically as well. On sites where there are large subterranean rocks, it may be desirable not to drag them to the surface where they will become future obstacles. In many cases, without the overload sensors, the ripper would have sufficient power to raise these buried rocks. By judicious adjustment of the overload sensors, this situation can be avoided.

Figure 9:
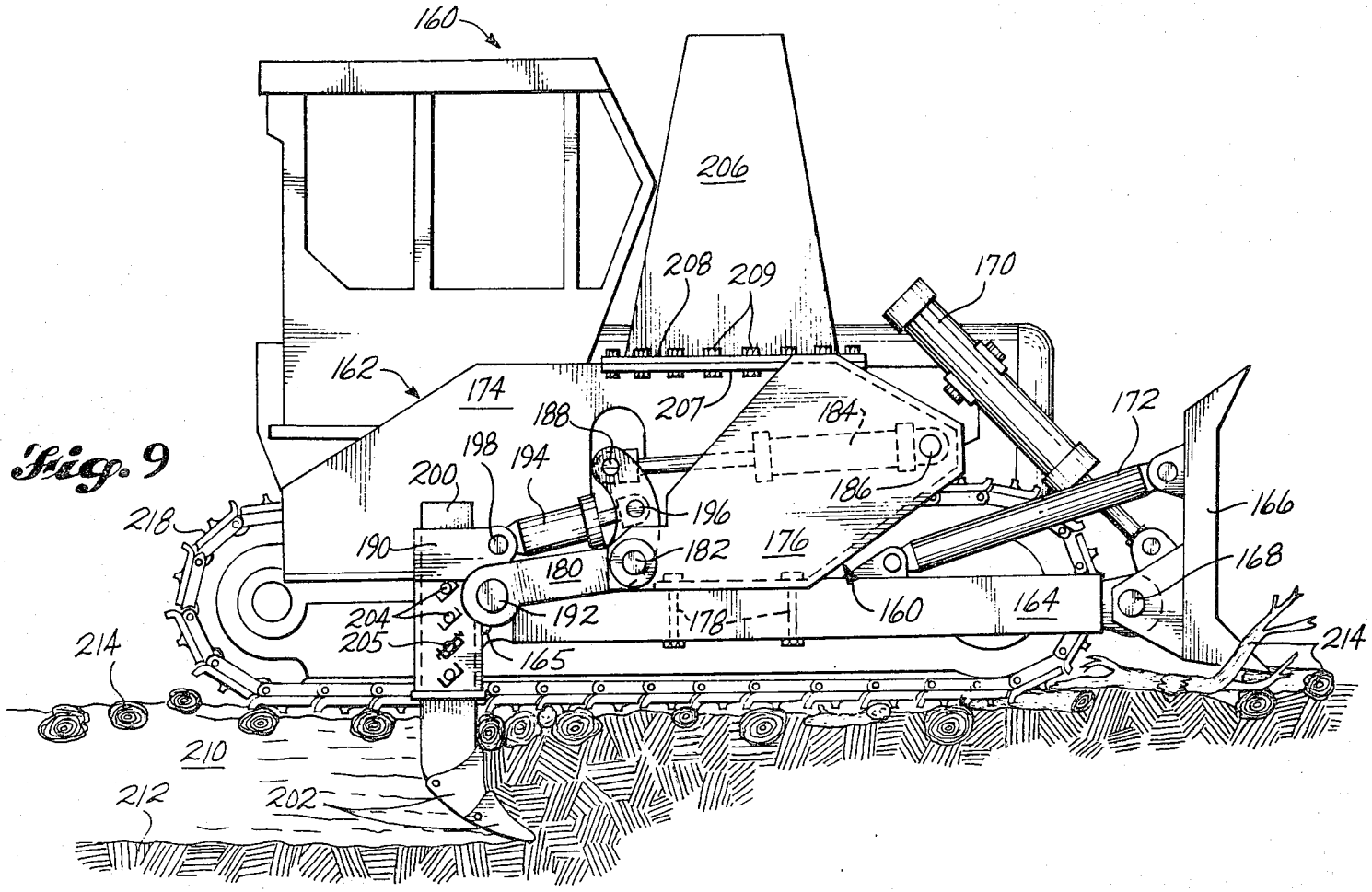
FIG. 9 is a side elevation view of another version of the present invention shown in operation on debris-covered land.
Figure 10:
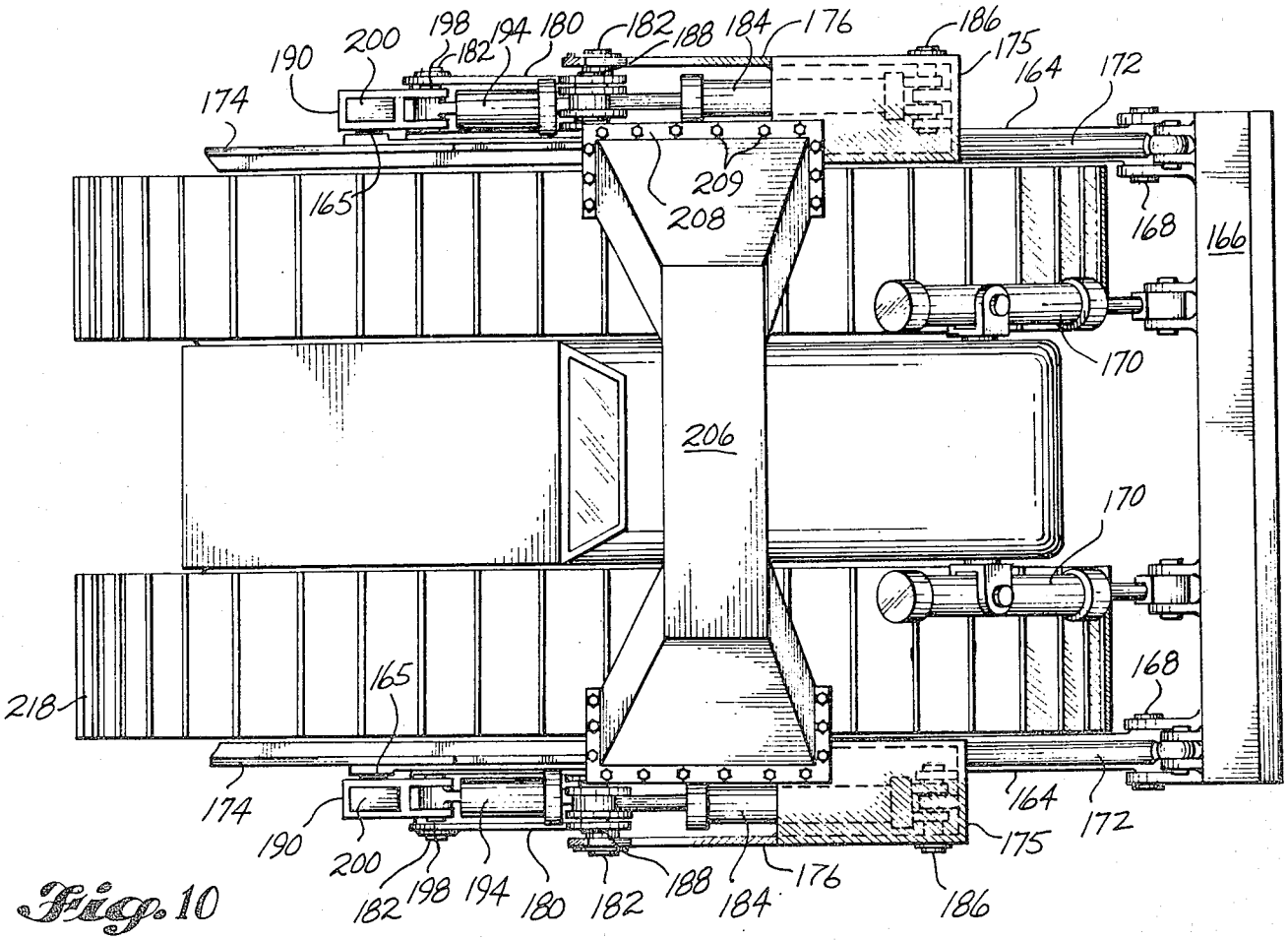
FIG. 10 is a top view of the ripper shown in FIG. 9.
Figure 11:
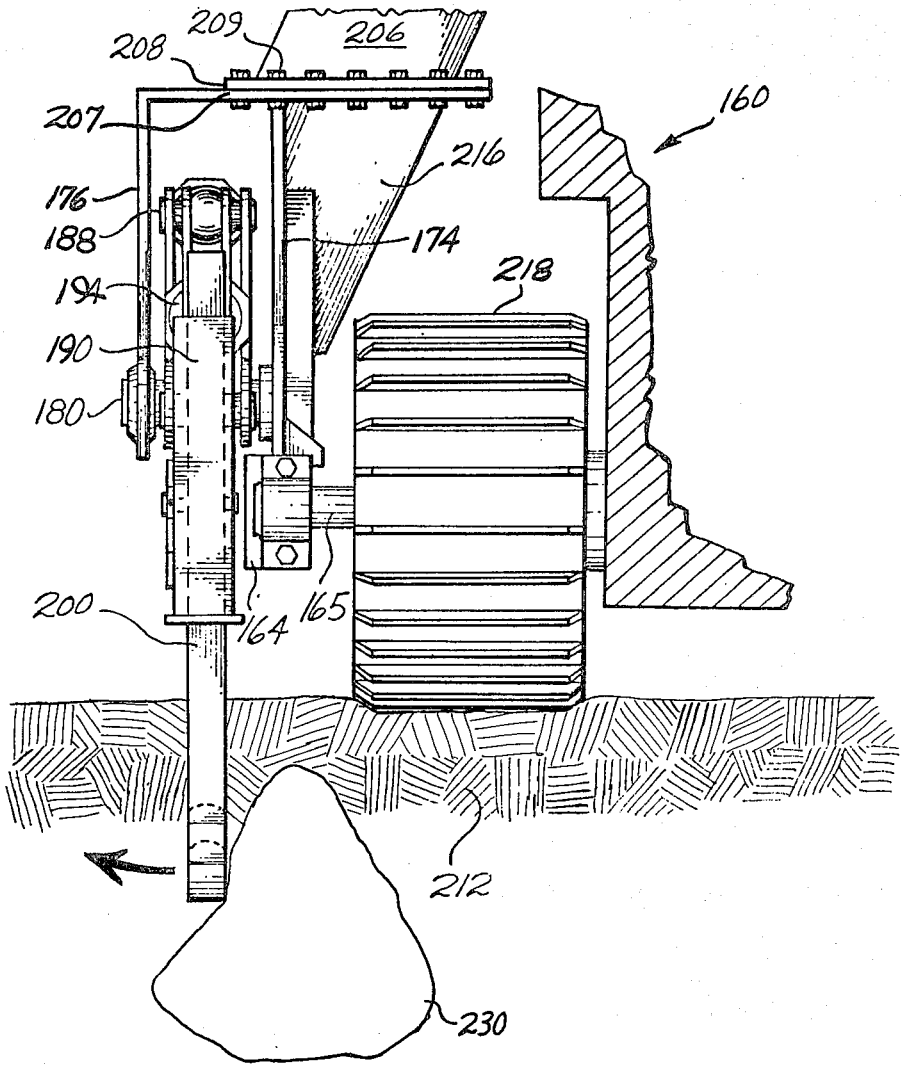
FIG. 11 is a fragmentary rear elevation view of the versions shown in FIGS. 9 and 10, showing detail of mounting a torque-resisting arch to the ripper subframe and further showing a cause of high lateral deflection forces.

FIGS. 9 through 11 show another version of the present invention. The ripper assembly, generally shown at 160, is mounted on a conventional crawler-type tractor 162, as in the previous example. The ripper mechanism is again contained within a box frame, which would typically be a welded fabrication. In this example, it comprises rear plate 174, front plate 176, and end plate 175 to give a box construction which is open at its rearward end. The end plate 175 can be considered as wrapping around the entire forward end of the frame from top to bottom. The frame is mounted to blade arm 164 by bolts 178. In the construction shown, the entire ripper can be readily removed from the crawler-type prime mover simply by removing the four bolts 178 and by disconnecting the appropriate hydraulic lines. Ripper control arm 180 is pivotally mounted within the frame at 182. The main control hydraulic cylinder 184 is pivotally mounted within the frame at its forward end 186. The piston rod of this cylinder is likewise pivotally mounted to the control arm 180 at 188. The other end of the control arm carries ripper tooth holder 190 which is pivotally mounted at 192. In the version shown, a secondary hydraulic cylinder 194 is mounted between appropriate pivot points 198 on tooth holder 190 and 196 on control arm 180 to form a compound radial control system. The ripper tooth holding means 190 includes a housing which contains ripper tooth 200. This contains a two-piece hardened tip 202. The extension of the tooth can be controlled by the use of adjustment pins which operate through adjustment openings 204. A single-pin engages one of an appropriate series of holes, not shown, in the ripper tooth and is held in place by a retainer 205.

In certain very difficult soils, particularly those which may contain large subterranean boulders, occasioned very high lateral forces may act on the ripper teeth. In order to prevent distortion of the equipment, it is sometimes necessary to provide a torque-resisting means to counteract these lateral forces. In many cases, the frame formed by the blade arms 164 and the blade 166 will be adequate. However, this version of the invention carries a torque-resisting arch 206 which connects the upper portions of the ripper frames on either side of the vehicle. The upper portion of the frame carries flange 207 which engages a like flange 208 on the bottom of the arch. A boxed gusset 216 (FIG. 11) on the back of frame plate 174 gives added strength to the assembly. The flanges are rigidly united by a series of bolts 209.

FIG. 9 illustrates one version of the present device in the process of making a rip in soil which is covered with logging debris. In the partial cross-section shown, the rip 210 has been made by teeth 200 in soil 212. The surface of the soil is covered with branches and tree tops 214. This debris would tend to be raked and bunched by conventional rippers. As can be seen in FIG. 9, this material is firmly held down by the weight of the tractor 160 under tracks 218 at the time it is engaged by the ripper teeth. Unless the debris is very large, it will simply be snapped off and the ripper will be able to proceed along its intended path without interruption. With the large prime movers normally employed for ripping, hardwood or softwood debris will be readily broken.

In most cases, a simple radial linkage will provide adequate speed and power for re-entry of the ripper teeth. In this case, the secondary cylinder 194 can simply be replaced by a rigid strut, not shown. This, in effect, serves to rigidly mount tooth holder 190 on the end of control arm 180. Of course, a rigidly mounted modified fabrication or casting can also be used to achieve the same result accomplished by using the strut. Use of the single hydraulic control cylinder 184 considerably simplifies the hydraulic circuitry as well as reducing the cost of the unit.

FIG. 11 exemplifies one situation in which a high lateral thrust would be placed upon a ripper tooth. In this figure, tooth 200 is grazing a large, subterranean rock 230 in a manner that would tend to force the tooth outward. This laterally acting force is magnified by the lever arm present between the point of contact between tooth 200 and the rock and the pivot point 192 of control arm 180. These lateral forces can become very severe, and if provision is not made for resisting them, blade arm 164 could be severely twisted or even fractured. In the present example, lateral forces in either direction are resisted by arch 206.

Having thus described preferred embodiments of the present invention, it should be evident to one skilled in the art that many variations can be introduced that will still be within the spirit of the invention. It is the intention of the inventor that the invention should be limited only as defined in the attached claims.

What is claimed is:

1. A soil ripper suitable for mounting on a crawler-type tractor which comprises in combination:

a. a generally U-shaped frame means having longitudinal arm portions and a transverse portion, said frame means adapted for being pivotally mounted on the tractor in the position normally occupied by a blade and its supporting blade arms;

b. rigid ripper subframes longitudinally hinged to each arm portion so as to permit limited lateral motion of the subframes, each subframe containing means for holding a ripper teeth and control means for determining the position and attitude of the tooth, so that when in ripping position the teeth will be positioned outside the tracks and between the fore and aft axles of the tractor; and c. torque resisting rigid strut means associated with the subframes, said strut means adapted to act between the subframes and the tractor frame in order to resist lateral forces experienced by the ripper teeth during operation.

2. The ripper of claim 1 in which the strut means terminate in ball ends acting in corresponding sockets on the subframes and tractor frame.

3. The ripper of claim 1 in which the control means comprises lever means pivotally mounted in the subframes, tool holder means for a ripper tooth operatively connected to each lever means, and hydraulic cylinder means operating between the subframes and lever means for moving the ripper teeth between an operating earth engaging position and an idling position where the teeth are free from ground contact.

4. The ripper of claim 1 in which the ripper teeth are approximately opposite the center of weight of the prime mover when in operation.

5. The ripper of claim 1 in which the prime mover is equipped with a blade and the ripper subframes are mounted on the blade arms.

* * * * *